US009060633B1

(12) United States Patent
Fiola

(10) Patent No.: US 9,060,633 B1
(45) Date of Patent: Jun. 23, 2015

(54) DOUBLE SLANTED NAPKIN HOLDER

(71) Applicant: Salvatore Fiola, Thiells, NY (US)

(72) Inventor: Salvatore Fiola, Thiells, NY (US)

( * ) Notice: Subject to any disclaimer, the term of this patent is extended or adjusted under 35 U.S.C. 154(b) by 0 days.

(21) Appl. No.: 13/775,403

(22) Filed: Feb. 25, 2013

(51) Int. Cl.
*A47G 21/16* (2006.01)
*A47F 7/00* (2006.01)

(52) U.S. Cl.
CPC ..... *A47G 21/16* (2013.01); *A47F 7/0014* (2013.01)

(58) Field of Classification Search
CPC ..... A47G 23/02; A47G 21/16; B65H 1/00
USPC ..... 211/42, 45, 50, 85.4, 73, 126.1, 126.2, 211/126.13, 126.16; D7/631, 632, 634; D19/75, 86, 88, 90, 91, 92; 24/7, 546; 206/233, 499, 541, 549
See application file for complete search history.

(56) References Cited

U.S. PATENT DOCUMENTS

| | | | | | |
|---|---|---|---|---|---|
| 395,473 | A | * | 1/1889 | Bartley | 24/67.9 |
| D27,316 | S | * | 7/1897 | Kaschembach | D19/75 |
| 805,895 | A | * | 11/1905 | Wedderburn | 273/150 |
| 1,453,065 | A | * | 4/1923 | Fargo | 29/237.5 |
| 1,455,524 | A | * | 5/1923 | Fargo | 211/42 |
| 1,488,282 | A | * | 3/1924 | Phillips | 132/294 |
| 1,658,689 | A | * | 2/1928 | Ridge | 312/348.3 |
| 1,659,119 | A | * | 2/1928 | Penning | 211/50 |
| D75,563 | S | * | 6/1928 | Horwitt | D7/631 |
| D86,168 | S | * | 2/1932 | Heusser | D21/392 |
| 1,866,966 | A | * | 7/1932 | Connor | 211/42 |
| D96,826 | S | * | 9/1935 | Estrella | D19/86 |
| 2,023,150 | A | * | 12/1935 | Ritchie | 211/50 |
| 2,224,530 | A | * | 12/1940 | Weinstein | 211/43 |
| D132,298 | S | * | 5/1942 | Jorgensen | D6/563 |
| D132,746 | S | * | 6/1942 | Schenker | D19/86 |
| 2,289,103 | A | * | 7/1942 | Cooper | 211/50 |
| 2,463,079 | A | * | 3/1949 | Albrecht | 24/578.1 |
| D155,655 | S | * | 10/1949 | Ulvad | D7/631 |
| 2,518,626 | A | * | 8/1950 | Lepper | 2/52 |
| 2,642,861 | A | * | 6/1953 | Tvedt | 211/51 |
| 2,769,550 | A | * | 11/1956 | Rollins | 211/11 |
| D190,511 | S | * | 6/1961 | d'Arbeloff | D7/600 |
| 3,013,668 | A | * | 12/1961 | Mennen | 211/40 |
| D206,129 | S | * | 11/1966 | Groff | D6/476 |
| 3,294,229 | A | * | 12/1966 | McConnell et al. | 206/223 |
| 3,505,709 | A | * | 4/1970 | Tirone | 24/546 |
| 3,572,428 | A | * | 3/1971 | Monaco | 165/80.3 |
| 3,586,173 | A | * | 6/1971 | Reynolds | 211/73 |
| 4,230,258 | A | * | 10/1980 | Lane | 206/585 |
| D257,932 | S | * | 1/1981 | Putt | D7/504 |
| D263,191 | S | * | 3/1982 | Moore | D7/504 |

(Continued)

*Primary Examiner* — Joshua J Michener
*Assistant Examiner* — Devin Barnett
(74) *Attorney, Agent, or Firm* — Richard A. Joel, Esq.

(57) ABSTRACT

This invention relates to a napkin holder for holding and dispensing sheet stock and in particular to a dual sided napkin holder-dispensing device that maintains the napkins in an upright position which facilitates removal therefrom. The invention comprises a napkin holder with slanted side walls, a divider between the side walls that is also parallel to the side walls, and a slanted base on each side, between the side wall and the center divider. The slanted base "forces" the napkins to lean towards the outside slanted walls. In so doing, the napkins lean against and are supported by the slanted side walls. The slanted base causes the napkins to be somewhat higher on the center side of the holder. Thus, the top of the centermost napkin on each side of the napkin holder always sticks up just a little more than the tops of the adjacent napkins. This makes it very easy to grasp just one napkin at a time, without disrupting the other napkins.

2 Claims, 2 Drawing Sheets

(56) References Cited

U.S. PATENT DOCUMENTS

| | | | | | |
|---|---|---|---|---|---|
| D272,834 | S | * | 2/1984 | Moore | D19/75 |
| D282,338 | S | * | 1/1986 | Putt | D7/504 |
| D308,228 | S | * | 5/1990 | Gecchelin | D19/90 |
| 4,944,413 | A | * | 7/1990 | Connell | 211/42 |
| D324,155 | S | * | 2/1992 | Hyman | D7/590 |
| D346,721 | S | * | 5/1994 | Feer | D7/631 |
| D369,620 | S | * | 5/1996 | Boutsakis et al. | D19/90 |
| 5,743,405 | A | * | 4/1998 | Reid | 206/541 |
| D399,366 | S | * | 10/1998 | Stravitz | D6/407 |
| D411,860 | S | * | 7/1999 | Stravitz | D19/75 |
| D413,490 | S | * | 9/1999 | Pinkas | D7/634 |
| D413,931 | S | * | 9/1999 | Ancona et al. | D19/90 |
| 5,971,168 | A | * | 10/1999 | Proulx | 211/85.4 |
| D416,449 | S | * | 11/1999 | Goodman et al. | D7/631 |
| D418,722 | S | * | 1/2000 | Kerr | D7/631 |
| D420,704 | S | * | 2/2000 | Coe | D19/75 |
| 6,082,553 | A | * | 7/2000 | Stravitz | 211/40 |
| D432,171 | S | * | 10/2000 | Stravitz | D19/90 |
| D432,578 | S | * | 10/2000 | Stravitz | D19/91 |
| 6,164,461 | A | * | 12/2000 | Ward et al. | 211/41.1 |
| D452,532 | S | * | 12/2001 | Ornelas | D19/90 |
| D485,466 | S | * | 1/2004 | Haruhiro | D6/629 |
| D497,184 | S | * | 10/2004 | Bain | D19/75 |
| D507,156 | S | * | 7/2005 | Heiberg | D7/631 |
| D519,000 | S | * | 4/2006 | Goodman et al. | D7/631 |
| D526,357 | S | * | 8/2006 | Killinger et al. | D19/90 |
| D632,739 | S | * | 2/2011 | Stravitz | D19/90 |
| D634,987 | S | * | 3/2011 | Guindi | D7/631 |
| D642,217 | S | * | 7/2011 | Von Der Lancken et al. | D19/91 |
| D652,267 | S | * | 1/2012 | Guindi | D7/631 |
| D669,320 | S | * | 10/2012 | Doty | D7/632 |
| D670,974 | S | * | 11/2012 | Goodman et al. | D7/631 |
| D670,975 | S | * | 11/2012 | Goodman et al. | D7/631 |
| D671,800 | S | * | 12/2012 | Apple et al. | D7/634 |
| 2003/0102274 | A1 | * | 6/2003 | Hollinger | 211/50 |
| 2003/0213263 | A1 | * | 11/2003 | Woog | 62/457.7 |
| 2004/0173475 | A1 | * | 9/2004 | Shimko | 206/233 |
| 2005/0023234 | A1 | * | 2/2005 | Head | 211/85.4 |
| 2005/0061702 | A1 | * | 3/2005 | Braun et al. | 206/494 |
| 2007/0068884 | A1 | * | 3/2007 | DiPietro et al. | 211/50 |
| 2007/0144706 | A1 | * | 6/2007 | Ohno | 165/80.3 |
| 2009/0195990 | A1 | * | 8/2009 | Honma | 361/710 |
| 2010/0124057 | A1 | * | 5/2010 | Bollmann et al. | 362/235 |
| 2010/0202479 | A1 | * | 8/2010 | Miyajima et al. | 372/35 |
| 2012/0276403 | A1 | * | 11/2012 | Nakagawa et al. | 428/610 |
| 2013/0056430 | A1 | * | 3/2013 | Kim et al. | 211/50 |

* cited by examiner

DOUBLE SLANTED NAPKIN HOLDER

CROSS REFERENCE TO RELATED APPLICATIONS

This application claims benefit under 35 USC §119(e) of U.S. Provisional Patent Application Ser. No. 61/634,482 filed Mar. 1, 2012 which application is incorporated fully by reference.

STATEMENT REGARDING FEDERALLY SPONSORED RESEARCH OR DEVELOPMENT

Not applicable

PARTIES TO A JOINT RESEARCH AGREEMENT

Not applicable

BACKGROUND OF THE INVENTION

1. Field of the Invention

This present invention relates to a napkin holder for holding and dispensing sheet stock and in particular to a dual sided napkin holder dispensing device that maintains the napkins in an upright sloped position which facilitates removal therefrom.

2. Description of Related Art Including Information Disclosed Under 37 CFR 1.97 & 1.98

The prior art includes U.S. Pat. No. 1,130,096 to McSheehy which relates to a sorting and filing case wherein the files rest on an inclined surface.

U.S. Pat. No. 167,584 to Stein discloses a portfolio stand having hinged spring flaps, a vertical abutment and an horizontal supporting platform, wherein the combined action of the stand and the spring flap permit a portfolio or single sheets of engravings or music to be fully retained in position and readily removable therefrom.

U.S. Pat. No. 1,728,694 to Morris discloses a dispensing device for folded napkins which includes a spring mechanism for maintaining the napkins in position.

U.S. Pat. No. 5,727,696 to Valulis discloses a business card holder with a resilient finger for maintaining the cards in position on a slanted base.

U.S. Pat. No. 1,874,642 to Shaffer, et al discloses a napkin dispenser which dispenses sheets from either face and comprises an upright casing to assist in the feeding of the napkins towards the respective faces. The bottom as shown is formed of two sloping portions.

U.S. Pat. No. 1,768,118 to Cofrin discloses a napkin dispenser with an inclined base and a flange that pushes the napkins towards an opening.

The prior art also includes the following patents which are more or less of general interest, U.S. Pat. No. 1,455,524 to Fargo; U.S. Pat. No. 3,180,493 to Kipnis; U.S. Pat. No. 4,943,024 to Meyer; U.S. Pat. No. 3,086,658 to Palmer; U.S. Pat. No. 47,624 to Dubernet; U.S. Pat. No. 2,226,975 to Jones; U.S. Pat. No. 1,424,080 to Carpenter; U.S. Pat. No. 352,654 to Morton; U.S. Pat. No. 653,605 to Alexander; U.S. Pat. No. 2,537,564 to Wolters, et al; U.S. Pat. No. 5,002,249 to Meyer; U.S. Pat. No. 657,544 to Jaeger; U.S. Pat. No. 651,058 to Rogers; U.S. Pat. No. 5,411,145 to Parks; U.S. Pat. No. 4,155,484 to Pastore; U.S. Pat. No. 2,769,550 to Rollins, et al; U.S. Pat. No. 6,422,402 to Hollinger; and, U.S. Pat. No. 2,407,119 and, U.S. Pat. No. 2,374,965 both to Weston.

SUMMARY OF THE INVENTION

Napkin holders are widely used in both restaurants and homes throughout the world. There are two main types of napkin holders generally speaking, passive and active. Passive napkin holders are simply shaped to hold napkins in a desired position. These holders may include the familiar tabletop napkin holders found in many homes holding horizontally stacked napkins and may be as simple as a folded U-shaped piece of Lucite®, plastic, metal, or decorative ceramic. Still other passive napkin holders may vertically stack napkins and simply rely on the tight bunching of a full batch of napkins to facilitate feeding and orientation.

Active napkin holders, on the other hand, typically use one of a variety of spring-tensioned devices to hold napkins in place until dispensing. Many active napkin holders also use an opening in the front to facilitate the removal of a single napkin. In the restaurant industry, large capacity napkin holders are commonplace. These holders usually provide a loading door with an opening through which one can remove napkins. These holders use a spring-loaded plate behind the napkins to maintain tension against the loading door and to maintain the napkins in an upright configuration.

Standard traditional paper napkin holders with upright vertical side walls work well as long as the holder is full of napkins. However, as napkins are removed from the holder, the remaining napkins start to droop and fall over. The napkin holder becomes rather useless because the napkins are no longer held neatly in an upright position. They fall over and the holder becomes quite messy. The less full the holder the more sloppy and droopy the remaining napkins become.

The double slant napkin holder of this invention solves the above problem. The essence of the invention is a napkin holder with slanted side walls, a divider between the side walls that is also parallel to the side walls, and a slanted base on each side, between the side wall and the center divider. The slanted base "forces" the napkins to lean towards the outside slanted walls. In so doing, the napkins lean against, and are supported by, the slanted side walls. In addition, the slanted base causes the napkins to be somewhat higher on the center side of the holder. Thus, the top of the centermost napkin on each side of the napkin holder always sticks up just a little more than the tops of the adjacent napkins. This makes it very easy to grasp just one napkin at a time, without disrupting the other napkins. No matter how many napkins are removed from each side, the remaining napkins stay neatly in place because they are leaning against and supported by the slanted outside walls of the napkin holder.

To fill the napkin holder with napkins, you simply slide the napkins down between the two parallel walls on each side of the holder. Thus, you can fill the holder with ease and remove one napkin at a time effortlessly without disrupting the remaining napkins. The napkins that remain in the holder always lean towards the outside walls and are supported by the outside walls and hence they always stay neatly in place and do not fall over and droop and become messy.

Accordingly, an object of this invention is to provide a new and improved napkin holder which facilitates the removal of napkins therefrom and maintains the napkins in a neat, upright, sloped position within the holder.

Another object of this invention is to provide a new and improved simple one-piece, inexpensive napkin holder which facilitates the removal of napkins therefrom.

A further object of this invention is to provide a two-sided springless napkin holder with no moving parts which maintains the napkins in a prescribed array within the holder and facilitates an orderly removal therefrom.

A still further object of this invention is to provide a one-piece napkin holder with outwardly slanted side walls, a divider between and parallel to the respective side walls, and a slanted base on each side to position the napkins against the side walls in a descending array.

A more specific object of this invention is to provide a new and improved napkin holder having outwardly slanted side walls and a center divider having opposite walls, each parallel to a respective side wall joined by an outwardly sloping base which supports napkins in a sloped array for ease of grasping.

BRIEF DESCRIPTION OF THE DRAWINGS

The above and other objects and advantages of the present invention may be more clearly seen when viewed in conjunction with the accompanying drawings wherein.

DETAILED DESCRIPTION OF THE INVENTION

Figure 1:
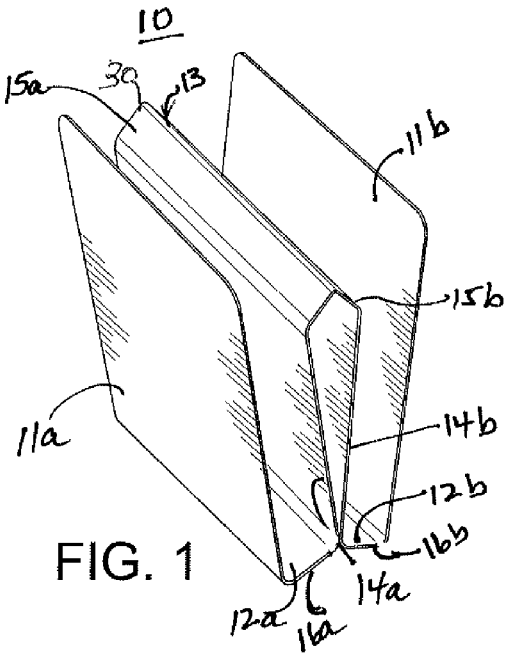
FIG. 1 is a perspective view of the preferred one-piece embodiment of the invention with no napkins in position.

Referring now to the drawings, the preferred embodiment of the invention, a double-slant napkin holder 10, is shown in FIG. 1. The invention comprises a one-piece metal napkin holder 10 having slanted side walls 11*a* and 11*b* which flare outwardly at an angle from the respective bases 12*a* and 12*b*. The bases 12*a* and 12*b* slant downwardly from a central divider 13 which includes side walls 14*a* and 14*b* which are substantially parallel to the respective side walls 11*a* and 11*b*. The side walls 14*a* and 14*b* are joined at their apex 30 by sloping triangular or curved faces 15*a* and 15*b*. The bases 16*a* and 16*b* of the side walls are in engagement with the bases 12*a* and 12*b* sloping downwardly therefrom. Since the metal holder 10 is formed in one piece, it is relatively inexpensive to make.

Figure 2:
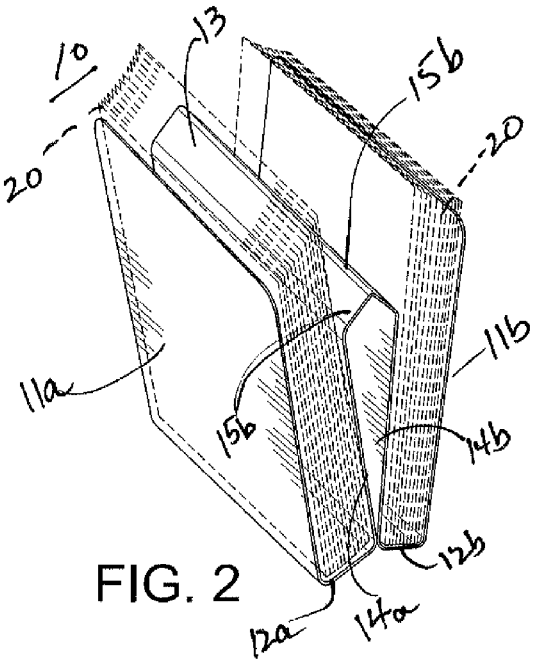
FIG. 2 is a perspective view of the invention of FIG. 1 with the device filled with napkins, shown in phantom.
Figure 2A:
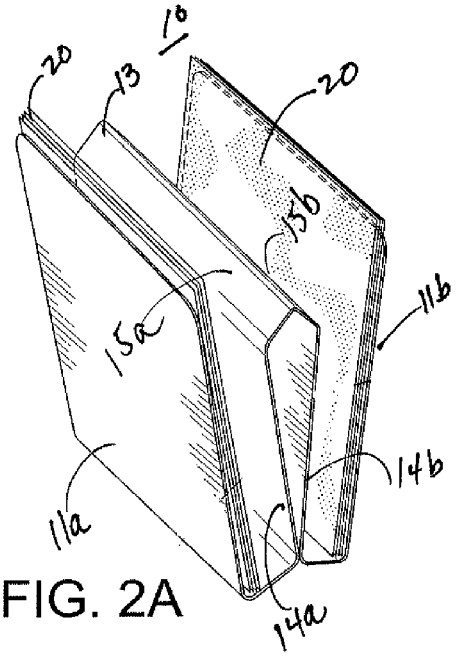
FIG. 2A is a view of the preferred embodiment of FIG. 1 with the holder partially filled with napkins, shown in phantom.

As shown in FIG. 2, the slanted bases, 12*a* and 12*b*, "force" the napkins 20 to lean towards the outside slanted walls 11*a* and 11*b*. The napkins 20 lean against and are supported by the slanted side walls. The slanted bases 12*a* and 12*b* cause the napkins 20 to be somewhat higher on the center portion of the holder 10. Thus, the top of the centermost napkin on each side of the divider 13 always sticks up just a little more than the tops of adjacent napkins 20. The dimensioning of the sloping base 12*a* and 12*b* makes it very easy to grab one napkin at a time without disrupting the other napkins. As shown in FIG. 2A no matter how many napkins 20 are removed from each side, the remaining napkins stay neatly in place because they are leaning against, and supported by, the slanted outside walls 11*a* and 11*b* of the holder 10.

To fill the napkin holder 10 with the napkins 20 you simply slide the napkins 20 down between the two parallel walls 11*a* and 14*a* and 11*b* and 14*b* on each side of the holder 10. Thus, you can fill the holder 10 with ease and remove one napkin at a time effortlessly, without disrupting the remaining napkins 20. The napkins 20 that remain in the holder 10 always lean towards the outside walls 11*a* and 11*b* and are supported by the outside walls 11*a* and 11*b*. Hence, they always stay neatly in place and do not fall over and droop and become messy.

Figure 3:
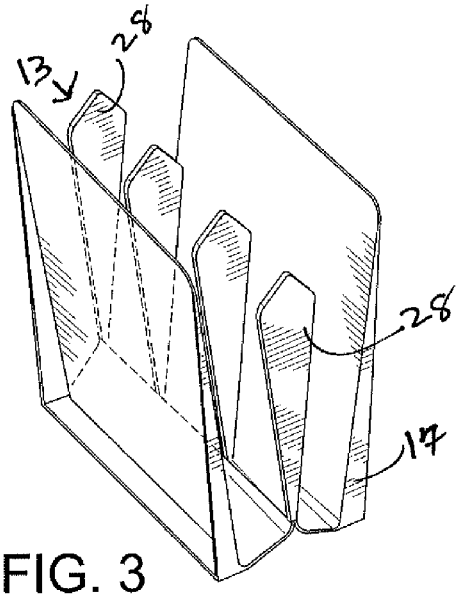
FIG. 3 is an alternate embodiment of the invention with the solid wall of the center divider in FIG. 1 reduced to vertical slices of divider to facilitate an injection molding process to produce a plastic holder.

FIG. 3 shows an alternate embodiment of the invention which is made from plastic. The preferred embodiment of FIG. 1 is made from stainless steel but it also could be made from metal, or plastic, or wood as well as bamboo. In FIG. 3, the solid walls 14*a* and 14*b* of the central divider 13 are reduced to just vertical ribs or slices 28 of the divider 13 to facilitate the injection molding process. In addition, to reinforce the side walls 11*a* and 11*b*, a small lip 17 can be molded around the edges of the side walls 11*a* and 11*b* and the base 12*a* and 12*b* to provide more strength and rigidity.

Figure 4:
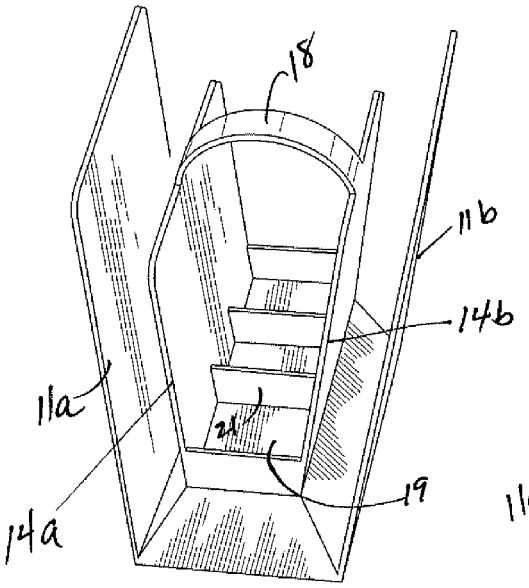
FIG. 4 shows a further alternate embodiment of the invention that incorporates spaces for salt and pepper shakers in the center of the holder.
Figure 4A:
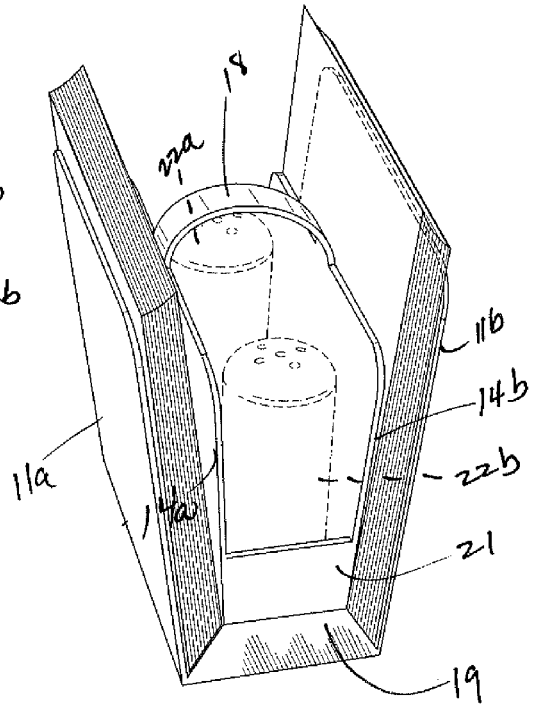
FIG. 4A shows the salt and pepper shakers in phantom and the napkins in the side pockets.

FIGS. 4 and 4A show a further alternate embodiment of the invention wherein the divider 13 comprises side walls 14*a* and 14*b* spaced apart from each other and joined at the top by a handle 18. The flat base 19 between the walls 14*a* and 14*b* includes transverse dividers 21 which provide space for salt and pepper shakers 22*a* and 22*b*.

Figure 5:
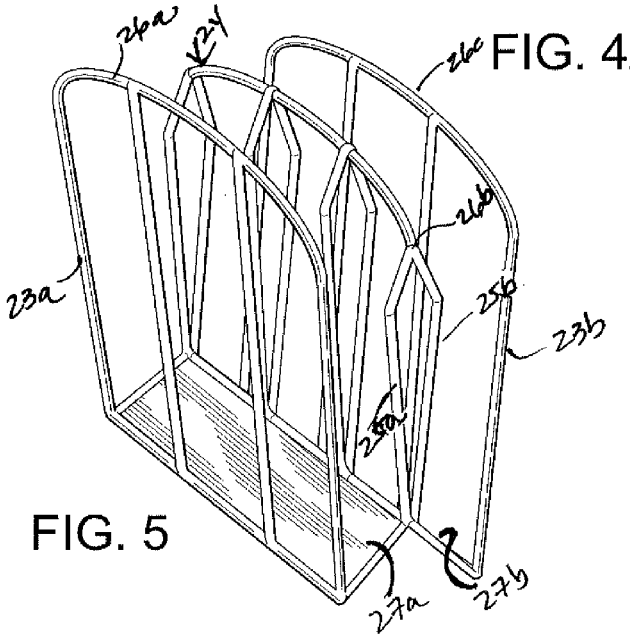
FIG. 5 is a further alternate embodiment of the invention that is made from wire rod. The napkin holder has solid bases but the bases also could be made from wire rod.

FIG. 5 depicts a further alternate embodiment of the invention wherein the side walls 23*a* and 23*b* are made of wire rod as well as the center divider 24 and its walls 25*a* and 25*b*. The vertical wall rods 23*a*, 23*b* and 25*a*, 25*b* are joined by curved rods 26*a*, 26*b*, and 26*c* at their top and extend upwardly from the slanted bases 27*a* and 27*b*.

While the invention has been explained by a detailed description of certain specific embodiments, it is understood that various modifications and substitutions can be made in any of them within the scope of the appended claims that are intended also to include equivalents of such embodiments.

What is claimed is:

1. A device for storing and dispensing napkins, each said napkins having a face, upper and lower edges, and a width, the device comprising:

a central divider; a first base and a second base attached to and on opposite sides of the divider and each extending downwardly therefrom in opposite directions and being in engagement at the divider;

a first rigid side wall extending upwardly and outwardly from the first base, the first rigid side wall has a width; and a second rigid side wall extending upwardly and outwardly from the second base, the second rigid side wall has a width; wherein the central divider includes a first divider wall extending upwardly and outwardly from the first base parallel to the first side wall and a second divider wall extending upwardly and outwardly from the second base parallel to the second side wall and a top portion sloping inwardly to a pointed apex joining and being coextensive with the first and second divider walls and being lower than said divider walls; and, wherein when in use napkins are inserted between the first side wall and the first divider wall and between the second side wall and the second divider wall, with corresponding napkin faces in contact therewith, said lower edge of the napkins engaging the first base and engaging the second base respectively so that the napkins are arranged in ascending order with the upper edges for ease of withdrawal extending towards the central divider due to said first and second downwardly extending bases and wherein the device is capable of standing upwardly on said bases; wherein the first and second side walls and the first and second divider walls include an open space therebetween, wherein the width of the napkins are capable of extending beyond the respective widths of the first and second side walls.

2. A device for storing and dispensing napkins in accordance with claim 1 wherein:

the device comprises a one-piece metal construction.

* * * * *